US006075870A

United States Patent [19]

Geschiere et al.

[11] Patent Number: 6,075,870

[45] Date of Patent: Jun. 13, 2000

[54] ELECTROACOUSTIC TRANSDUCER WITH IMPROVED SHOCK RESISTANCE

[75] Inventors: Onno Geschiere; Hendrik Dolleman, both of Amsterdam; Huib Groot Obbink, Amstelveen; Aart Zeger van Halteren, Hobrede, all of Netherlands

[73] Assignee: Microtronic B.V., Netherlands

[21] Appl. No.: 08/980,835

[22] Filed: Dec. 1, 1997

[30] Foreign Application Priority Data

Dec. 2, 1996 [AN] Netherlands Antilles ..... 1004669

[51] Int. Cl.[7] ..... H04R 25/00

[52] U.S. Cl. ..... 381/417; 381/324; 29/595

[58] Field of Search ..... 381/322, 324, 381/417, 418; 29/595

[56] References Cited

U.S. PATENT DOCUMENTS

| | | | |
|---|---|---|---|
| 1,871,739 | 8/1932 | Ringel . | |
| 2,143,097 | 1/1939 | Warnke | 179/119 |
| 2,163,161 | 6/1939 | Wadsworth | 175/339 |
| 2,794,862 | 6/1957 | Topholm | 179/114 |
| 2,912,523 | 11/1959 | Knowles et al. | 179/108 |
| 2,994,016 | 7/1961 | Tibbetts et al. | 317/172 |
| 3,005,880 | 10/1961 | Simshauser | 179/114 |
| 3,111,563 | 11/1963 | Carlson | 179/114 |
| 3,163,723 | 12/1964 | Tibbetts | 179/180 |
| 3,172,022 | 3/1965 | Tibbetts | 317/173 |
| 3,177,412 | 4/1965 | Carlson | 317/173 |
| 3,182,384 | 5/1965 | Carlson et al. | 29/155.57 |
| 3,249,702 | 5/1966 | Carlson | 179/115 |
| 3,347,991 | 10/1967 | Carlson | 179/114 |
| 3,413,424 | 11/1968 | Carlson | 179/115 |
| 3,432,622 | 3/1969 | Sebesta et al. | 179/115 |
| 3,531,745 | 9/1970 | Tibbetts | 335/231 |
| 3,560,667 | 2/1971 | Carlson | 179/114 |
| 3,573,397 | 4/1971 | Sawyer et al. | 179/115 |
| 3,588,383 | 6/1971 | Carlson et al. | 179/119 |
| 3,617,653 | 11/1971 | Tibbetts et al. | 179/114 |
| 3,671,684 | 6/1972 | Tibbetts et al. | 179/117 |
| 3,766,332 | 10/1973 | Carlson et al. | 179/114 |
| 3,836,733 | 9/1974 | Cragg | 179/119 |
| 3,885,553 | 5/1975 | Vecchio | 128/24.1 |
| 3,935,398 | 1/1976 | Carlson et al. | 179/114 |
| 3,979,566 | 9/1976 | Willy | 179/115.5 |
| 4,000,381 | 12/1976 | Plice et al. | 179/114 |
| 4,015,227 | 3/1977 | Yasuhiro Riko et al. | 335/231 |
| 4,272,654 | 6/1981 | Carlson et al. | 179/119 |
| 4,360,711 | 11/1982 | Steiner | 179/115 |
| 4,410,769 | 10/1983 | Tibbetts | 179/119 |

(List continued on next page.)

FOREIGN PATENT DOCUMENTS

| | | |
|---|---|---|
| 0 094 992 B1 | 9/1986 | European Pat. Off. . |
| 564941 | 4/1923 | France . |
| 551182 | 5/1923 | France . |
| 1 146 542 | 2/1961 | Germany . |
| 2 085 694 | 4/1982 | United Kingdom . |

OTHER PUBLICATIONS

Gawinski, Michael J., Hearing Aid Transducer Damage: A Practical Guide to Prevention, The Hearing Journal, Oct. 1991. vol. 44, No. 10, pp. 1–4, Copyright 1991, The Laux Co., Inc.

*Primary Examiner*—Curtis A. Kuntz
*Assistant Examiner*—Phylesha Dabney
*Attorney, Agent, or Firm*—Jenkens & Gilchrist

[57] ABSTRACT

A transducer which is particularly suitable for hearing aids is set forth which has improved resistance to mechanical shock. The transducer includes a coil having a tunnel, a magnetic member with a pair of magnets defining an air gap and an armature extending through the tunnel and into the air gap. The coil is rotated with respect to the magnetic member in a manner such that the coil forms a stop for the armature, thus preventing excessive deflection of the armature leg in the occurrence of a shock. The armature may also be provided with expanded edge portions which assist in limiting its deflection.

20 Claims, 5 Drawing Sheets

U.S. PATENT DOCUMENTS

| | | | |
|---|---|---|---|
| 4,425,482 | 1/1984 | Bordelon et al. | 179/120 |
| 4,518,831 | 5/1985 | Stanley et al. | 179/119 |
| 4,944,017 | 7/1990 | Cognasse et al. | 381/79 |
| 4,956,868 | 9/1990 | Carlson | 381/189 |
| 5,068,901 | 11/1991 | Carlson | 381/68.6 |
| 5,193,116 | 3/1993 | Mostardo | 381/69 |
| 5,299,176 | 3/1994 | Tibbetts | 367/175 |
| 5,335,286 | 8/1994 | Carlson et al. | 381/191 |
| 5,610,989 | 3/1997 | Salvage et al. . | |
| 5,647,013 | 7/1997 | Salvage et al. . | |
| 5,708,721 | 1/1998 | Salvage et al. . | |
| 5,757,947 | 5/1998 | Van Halteren et al. . | |
| 5,809,158 | 9/1998 | Van Halteren et al. . | |
| B1 4,473,722 | 6/1995 | Wilton | 381/200 |

ELECTROACOUSTIC TRANSDUCER WITH IMPROVED SHOCK RESISTANCE

BACKGROUND OF THE INVENTION

The invention relates to a transducer, in particular suitable for hearing aids, comprising a coil having a first air gap, a magnetic member having a second air gap, and an armature, the first and the second air gaps being in line, and the armature comprising an armature leg extending through both air gaps.

Such transducers are known per se. The above armature leg is connected therein with a diaphragm. Vibrations of the diaphragm are transmitted to the armature leg, and the vibrating armature leg causes an electric alternating current in the coil. Conversely, an alternating current supplied to the coil causes a vibration of the armature leg, which is transmitted to the diaphragm.

With the vibrations of the above armature leg occurring under normal conditions the displacements thereof are relatively small. In extreme cases, however, the armature leg can touch the magnet.

Transducers of the above type have the problem that when a shock or impact load is exerted on the transducer, such as, e.g., when the transducer falls, the armature leg bends so far that plastic deformations can occur in the armature leg, which is undesirable.

A transducer of the above type is described, e.g., in the international patent application WO 94/10817. In this publication the above shock problem is already recognized, and the publication describes different limiting means for increasing the shock resistance of a transducer. These means are based on the limitation of the freedom of movement of the above armature leg in a central position thereof.

In one embodiment these limiting means are a projection formed as a deformation at the armature leg.

In another embodiment these limiting means are a separate stop member functioning as a bumper, which may be fitted to the armature leg.

In yet another embodiment these limiting means are a separate spacer with a limited air gap, which is arranged between the coil and the magnet.

In yet another embodiment the publication proposes to give the interior of the coil body a specific form.

All these proposals, however, have the disadvantage that it is not possible to make use of standard parts and/or that additional parts must be added. This increases the expenses associated with such a transducer.

Another disadvantage of the above proposals is that it is not possible to adjust the protective means. In general, the coil is wound on a coil body formed as an injection molded product and therefore has a certain tolerance. When the interior of a coil is used as a stop in the manner as proposed in the above publication, a rather large spreading of the shock resistance of the individual transducers is obtained, which spreading cannot be reduced by an adjusting procedure.

Another disadvantage of the above proposals is the fact that it is desirable for a proper and reliable operation of the transducer that the armature leg is symmetrically positioned in the magnet housing and that the protective means have a symmetrical effect in both directions of vibration of the armature leg. This implies that the parts proposed by the above publication must be produced with a rather high accuracy.

SUMMARY OF THE INVENTION

It is a general object of the present invention to solve the above problems.

More in particular, the object of the present invention is to provide a transducer which can be assembled from standard parts, and in which a predetermined desired freedom of vibration of the armature leg can be adjusted with a rather high accuracy, without the parts needing to have so low a tolerance that the percentage of rejects and/or the expenses increase.

According to a first aspect of the present invention the coil is fixed to the magnet housing for rotation with respect to its longitudinal axis.

According to a second aspect of the invention the armature leg is provided in a predetermined position within the first air gap with an expanded portion.

According to another aspect of the present invention there is provided a process for attaching a coil and a magnetic member to each other, which comprises the use of an auxiliary defining the desired freedom of vibration of the armature leg, the coil and the magnetic member being slid round this auxiliary and rotated with respect to each other, until they touch this auxiliary.

BRIEF DESCRIPTION OF THE DRAWINGS

These and other aspects, features and advantages of the present invention will be clarified by the following description of a preferred embodiment of a transducer according to the invention, with reference to the accompanying drawings, in which the same or comparable parts are designated by the same reference numerals, and in which.

DETAILED DESCRIPTION OF THE DRAWINGS

Figure 1:
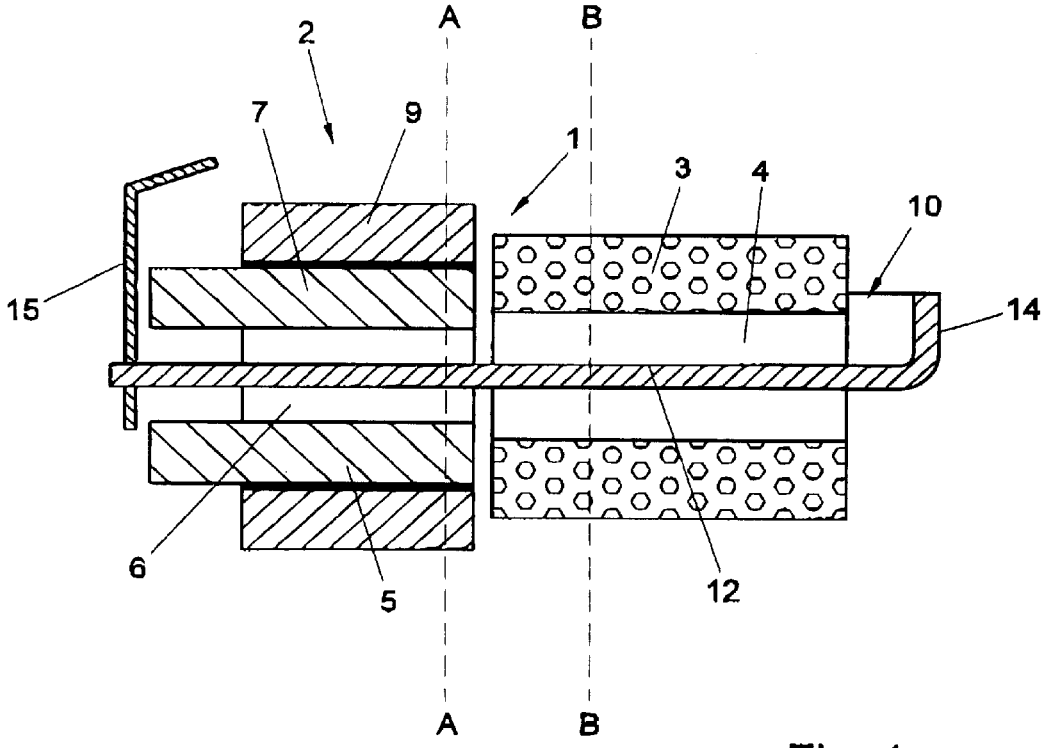
FIG. 1 is a diagrammatic cross-sectional view of a transducer.

FIG. 1 is a diagrammatic cross-sectional view of a transducer generally designated by reference numeral 1. The transducer 1 comprises a magnetic member 2 and a coil 3. In the embodiment shown, the magnetic member 2 comprises a magnet housing 9 and two magnetic elements 5, 7, spaced apart therein. The coil 3 has a first air gap 4, the cross section of which may be substantially rectangular. The two magnetic elements 5, 7 define between each other a second air gap 6, the cross section of which may also be substantially rectangular. The two air gaps 4 and 6 are arranged in line.

Figure 2:
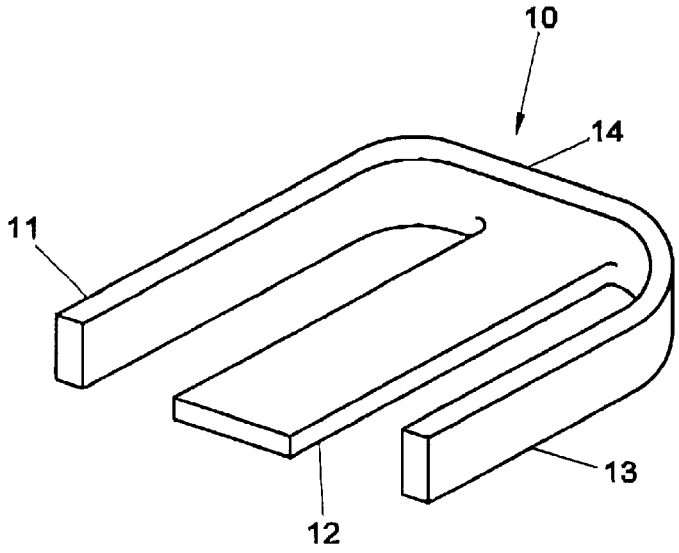
FIG. 2 is a diagrammatic perspective view of an armature.

The transducer 1 further comprises an armature 10, which, in the example shown, is an E-shaped armature. In general, such an E-shaped armature 10 has three legs 11, 12, 13, lying parallel with each other, as diagrammatically shown in the perspective view of FIG. 2, which legs are interconnected at one end (the right end in FIGS. 1 and 2)

by a leg connecting part 14. The middle armature leg 12 is positioned within the two air gaps 4 and 6 arranged in line, the leg connecting part 14 being located on the side of the coil 3. The two outer armature legs 11 and 13 extend on the outer side along the coil 3 and the magnet housing 9 and are affixed to the magnet housing 9, but, this is not illustrated in these Figures for simplicity's sake. The free end of the middle armature leg 12 is connected by means of a connecting element 15 to a diaphragm, not shown in the Figures for simplicity's sake.

The operation of such a transducer 1 is as follows. When an electrical signal, originating from an amplifier, not shown, is supplied to the coil 3, the middle armature leg 12 is set in vibration, in cooperation with a magnetic field of the magnetic member 2. The movement of vibration of the middle armature leg 12 is transmitted via the connecting element 15 to the above diaphragm, which causes sound vibrations. Conversely, sound vibrations can set the above diaphragm in vibration, as a result of which the middle armature leg 12 is set in vibration via the connecting element 15, thereby generating in the coil 3 an electrical signal capable of being detected and processed.

Figure 3A:
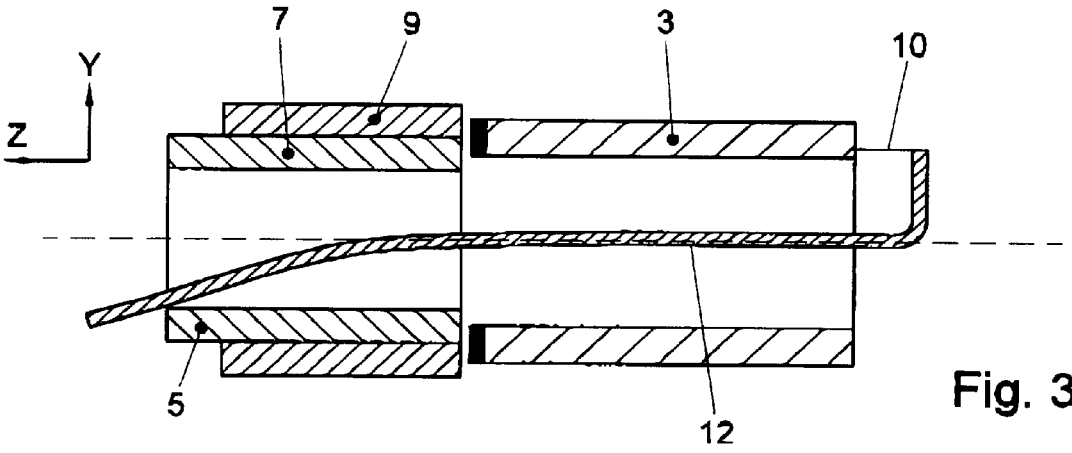
FIGS. 3A–C are cross-sectional views comparable with FIG. 1, which illustrate the deformation of the armature.
Figure 3B:
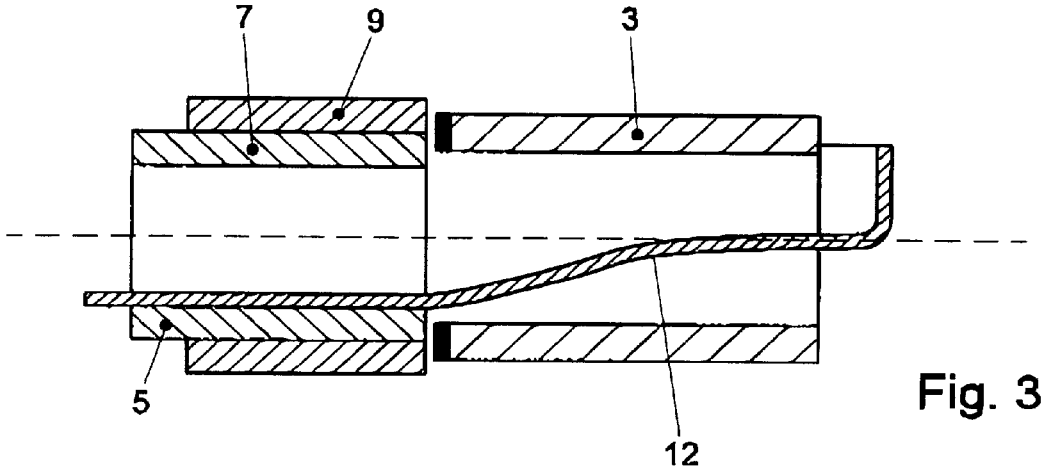
Figure 3C:
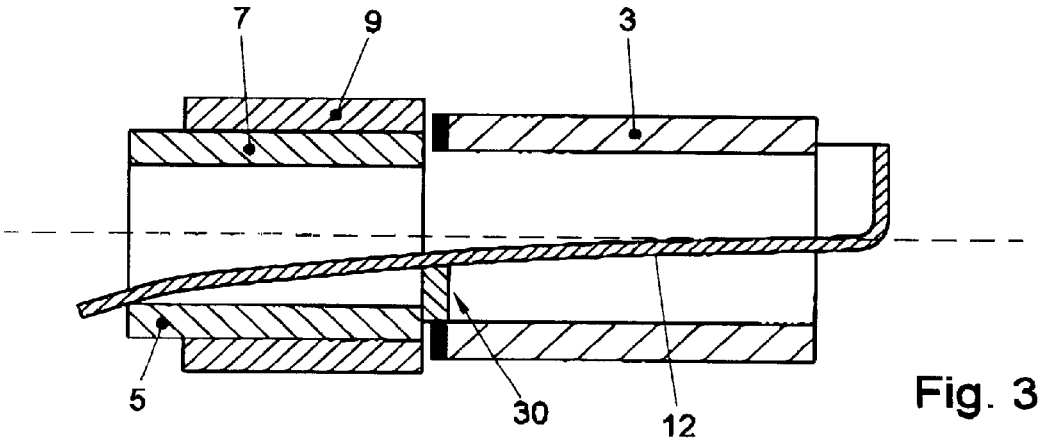

FIGS. 3A–C, which, for simplicity's sake, only show the middle armature leg 12, the coil 3, and the magnetic elements 5 and 7, illustrate, on a greatly enlarged scale, the need for means for increasing the shock resistance. In normal use, the free end of the middle armature leg 12 will carry out a vibration relative to a state of equilibrium designated by a dotted line, which middle armature leg 12 is slightly bent for its full length. Under normal conditions the middle armature leg 12 remains clear of the coil 3 and the magnetic elements 5 and 7, but in extreme cases the end of the middle armature leg 12 could touch the magnetic elements 5 and 7, as shown in FIG. 3A. Although such a touch is in itself not conducive to the functioning of the transducer 1, this touch is in itself not injurious to the transducer 1. In fact, this touch can even be regarded as a protection, because a further deflection of the middle armature leg 12 relative to its state of equilibrium is prevented, so that the deformation of the middle armature leg 12 always remains within the elastic range.

When, however, a large acceleration is exerted on the middle armature leg 12, e.g. by a shock as a result of falling, a central part of the middle armature leg 12 can further deflect from the state of equilibrium, although the free end of the middle armature leg 12 is stopped by a magnetic element, as shown in FIG. 3B for a downward deflection. In case of such a deformation, the middle armature leg 12 can plastically deform, which must be regarded as damage.

In order to reduce the risk of such a plastic deformation, there may be provided means 30 which receive a central part of the middle armature leg 12, thus inhibiting an unduly large deflection of this central part, as shown in FIG. 3C for a downward deflection.

In the prior art such receiving means 30 are already proposed. As described above, WO-94/10817 proposes to form a protuberance at the middle armature leg 12 or to fix an additional stop member at the middle armature leg 12 or at the coil. The disadvantages of such an approach have also been described above.

On the other hand, the receiving means 30 according to the present invention are defined by the standard parts themselves, as will be clarified in the following.

Figure 4A:
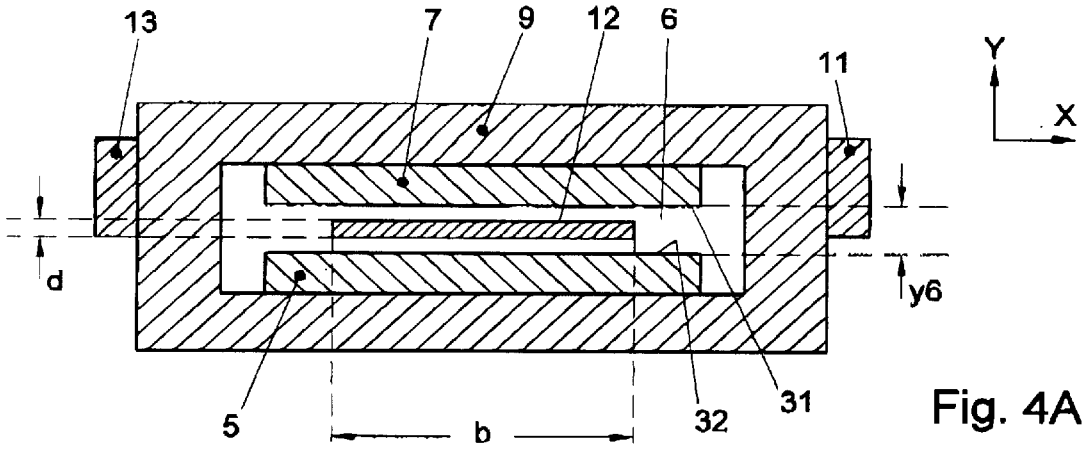
FIGS. 4A and 4B are cross-sectional views taken along respectively lines A—A and B—B in FIG. 1 for a conventional transducer.
Figure 4B:
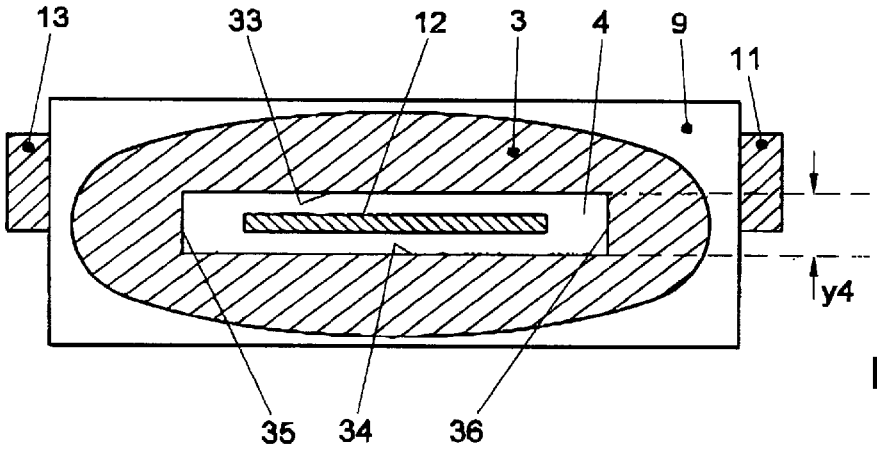

FIG. 4A is a diagrammatic cross-sectional view taken along the line A—A in FIG. 1, and FIG. 4B is a diagrammatic cross-sectional view taken along the line B—B in FIG. 1, valid for a conventional transducer with standard parts without receiving means 30. The middle armature leg 12 has a substantially rectangular cross section having a thickness d and a width b. Reference will be made below to an orthogonal coordinate system, the x-axis of which is directed according to the width direction of the middle armature leg 12, whereas the y-axis is directed according to the thickness direction of the middle armature leg 12, i.e. the direction of vibration of the middle armature leg 12. The z-axis is directed according to the longitudinal direction of the middle armature leg 12 in its state of equilibrium, i.e. the dotted line of FIGS. 3A–C.

FIG. 4A shows that the middle armature leg 12 is symmetrically arranged with respect to the magnet housing 9 with the magnetic elements 5, 7. More in particular, the center line of the magnet housing 9 and the magnetic elements 5, 7 is aligned with the above z-axis, and the middle armature leg 12 is located precisely in the middle of the second air gap 6. In FIG. 4A the facing surfaces 31, 32 of the magnetic elements 5, 7 are shown as flat faces which are perpendicular to the y-axis, so that the second air gap 6 has for its full x-dimension an equal y-dimension, which will be referred to as $y_6$. It is to be noted, however, that these facing surfaces 31, 32 of the magnetic elements 5,7 need not be flat faces, as will be clarified below.

Within the scope of the present invention the term "freedom of vibration" of the middle armature leg 12 will be taken to mean the distance which the middle armature leg 12 is free to travel in the direction of vibration, i.e. the y-direction. The freedom of relative to the magnetic elements 5, 7 will be referred to as "freedom of magnet vibration" $F_M$. It will be clear that in the configuration shown in FIG. 4A $F_M$ satisfies the following equation:

$$F_M = \tfrac{1}{2}\cdot(y_6 - d) \tag{1}$$

FIG. 4B, which, for clarity's sake, does not show the magnetic elements 5, 7, shows the first air gap 4 of the coil 3 as an air gap having a substantially rectangular cross section, defined by first coil inner faces 33, 34, designed as flat faces perpendicular to the y-axis, and second coil inner faces 35, 36, designed as flat faces perpendicular to the x-axis. In that case the first air gap 4 of the coil 3 has for its full x-dimension the same y-dimension, which will be referred to as $y_4$, it is to be noted, however, that the facing first inner faces 33, 34 need not be flat faces, as will be clarified below.

In the conventional arrangement the coil 3 may be aligned with the middle armature leg 12, i.e. the middle armature leg 12 is located approximately in the middle of the first air gap 4. Then the armature has sufficient clearance relative to the coil. The core of the coil is often selected larger than the core of the magnet housing so as to facilitate the production. In the configuration shown in FIG. 4B the freedom of vibration relative to the coil 3, which will be referred to as "freedom of coil vibration" $F_S$, then satisfies the following equation:

$$F_S = \tfrac{1}{2}\cdot(y_4 - d) \tag{2}$$

When producing the coil 3, this coil is wound on a winding core, which is removed after winding. The contour and the dimensions of the first air gap 4 therefore correspond to the outer contour and outer dimensions of this wound core. This wound core is normally produced as an injection molded product and therefore has a rather high tolerance, at least a tolerance higher than the tolerance of the second air gap 6. Consequently, the nominal value of the y-dimension of the first air gap 4 is generally selected larger than that of the second air gap 6, as shown in FIGS. 1 and 3. In a specific embodiment the following dimensions apply:

$$b = 1.51 \pm 0.02 \text{ mm}$$
$$d = 0.2 \pm 0.005 \text{ mm}$$
$$Y_6 = 0.395 \pm 0.015 \text{ mm}$$
$$Y_4 = 0.50 \pm 0.030 \text{ mm}$$

When carrying out a movement of vibration, the middle armature leg 12 will bend for its full length, as described above and shown in FIG. 3A. This implies that protective means which increase the shock resistance must define a smaller freedom of vibration than for the free end of the middle armature leg 12. In the conventional arrangement, as illustrated in FIGS. 3 and 4, this is not achieved. Such a smaller freedom of vibration for a central part of the middle armature leg 12 could be obtained by selecting the y-dimension of the first air gap 4 of the coil 3 smaller than that of the second air gap 6 of the magnetic elements 5, 7. Then, in fact, the freedom of vibration of this central part would be defined by the freedom of coil vibration $F_S$. However, because of the above tolerance of the vertical dimension of the first air gap 4 this means a large spreading in the freedom of vibration of this central part for the individual transducers relative to each other.

According to the inventive concept a relatively accurate adjustment of the freedom of vibration of this central part becomes possible, even when the y-dimension of the first air gap 4 of the coil 3 is larger than that of the second air gap 6 of the magnetic elements 5, 7, although the invention is also applicable when the y-dimension of the first air gap 4 of the coil 3 is smaller than that of the second air gap 6 of the magnetic elements 5, 7.

Figure 5:
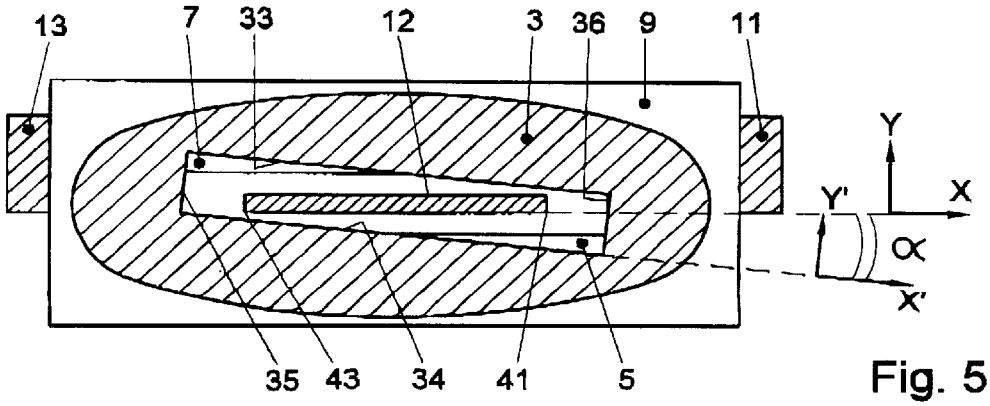
FIG. 5 is a cross-sectional view comparable with FIG. 4B of a transducer according to the present invention.

According to the present invention this is obtained by rotating the coil 3 through an angle α round the above z-axis, as illustrated in FIG. 5. FIG. 5 is a cross-sectional view comparable to FIG. 4B through a transducer 1, which is constructed according to the present inventive concept, starting from the same conventional components as illustrated in FIGS. 4A and 4B. Associated with the coil 3 is a second orthogonal coordinate system X'Y'Z', which coordinate system X'Y'Z' reflects the symmetry of the coil 3, i.e. in the practical example shown, in which the first air gap 4 has a rectangular cross section, the Z'-axis is directed according to the longitudinal axis of the first air gap 4, the X'-axis is perpendicular to the surfaces 35, 36, and the Y'-axis is perpendicular to the surfaces 33, 34. The Z'-axis of the coil 3 coincides with the Z-axis of the combination of the armature 10 and the magnets 5, 7, but the X'-axis lies at the above angle α to the X-axis.

It will be clear that since the freedom of coil vibration $F_S$ of the middle armature leg 12 depends on, inter alia, the above angle α, namely according to the equation equation $$2F_S = y_4 - d - (b - y_4 \cdot \tan(\tfrac{1}{2}\alpha)) \cdot \tan(\alpha) \quad (3)$$

More in particular, it will be clear that, with the direction illustrated in FIG. 5 of the displacement of the coil 3 relative to the magnetic member 2, the freedom of coil vibration at the upper side of the middle armature leg 12 is defined by the distance measured in the Y-direction between the upper coil inner face 33 and the side edge 41 of the middle armature leg 12 directed towards the first armature leg 11, while the freedom of coil vibration is defined at the lower side of the middle armature leg 12 by the distance measured in the Y-direction between the lower coil inner face 34 and the side edge 43 of the middle armature leg 12 directed towards the middle armature leg 12.

It will further be clear that the freedom of coil vibration $F_S$ as determined by formula (3) may be smaller than the freedom of magnet vibration $F_M$ as determined by formula (1), even when the Y'-dimension of the first air gap 4 of the coil 3 is larger than the Y-dimension of the second air gap 6 of the magnetic member 2, simply by selecting α large enough, which is also illustrated in FIG. 5.

It will then be clear that the middle armature leg 12, with ever increasing deflection relative to the state of equilibrium, will first touch the thus rotated coil body 3 at the end of coil 3 directed towards the magnet housing 9. α may be selected so large that the middle armature leg 12 touches the thus rotated coil body 3 earlier than that the end of the middle armature leg 12 comes into contact with a magnetic element 5, 7. α may also be selected less large, such that the end of the middle armature leg 12 comes into contact with a magnetic element 5, 7 before the middle armature leg 12 touches the thus rotated coil body 3. Preferably, however, α is selected such that the middle armature leg 12 touches the thus rotated coil body 3 and a magnetic element 5, 7 simultaneously, so that then a support in two points is obtained.

The precise value of α with which the coil 3 is fixed to the magnetic member 2, will depend on the dimensions of the air gaps 4 and 6 of the middle armature leg 12. In general, it will be possible to predict according to which curve the middle armature leg 12 bends and to calculate the desired angle α on the basis thereof. In general, α will be within the range from a few degrees up to ca. 15°.

Figure 6:
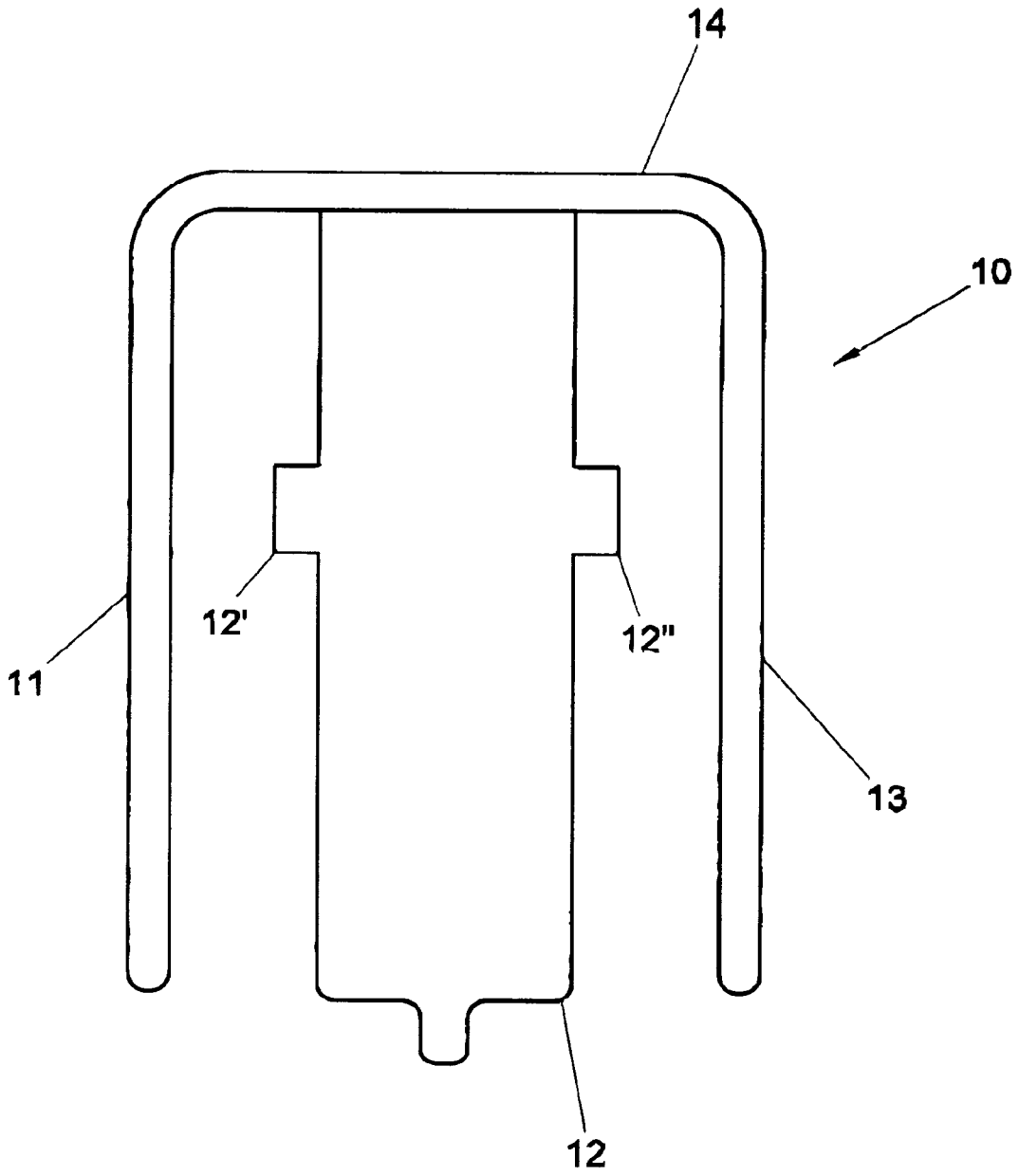
FIG. 6 is a top view of an armature according to a second aspect of the invention.

In the above example the coil 3 has a Z-dimension of 2.48 mm, the magnets 5, 7 have a Z-dimension of 2.04×0.05 mm, and the above Y-deflection is 0.098 mm. In such an embodiment the above angle α is therefore approximately 8°. FIG. 6 shows an armature leg 12 which, according to a second aspect of the invention, seen in the longitudinal direction, is provided on both sides with two cam-shaped projections 12', 12", by which the armature leg is locally expanded. The cam-shaped projections are arranged on the armature leg in a position such that in a mounted transducer they lie within the first air gap, i.e. the air gap 4 in the coil 3. When the armature leg 12 deflects as a result of a shock, the projections 12', 12" will be the first to strike the inner faces 33, 34 of the coil 3. Without such projections the armature will always be received by the faces 33, 34 at the location of the transition from the magnet housing to the coil, as becomes immediately apparent from FIG. 3B. The projections 12', 12" offer the possibility to freely select the place where the armature first strikes the inner faces 33, 34 of the coil. In practice, it turns out that an even better shock resistance can thereby be realized. Because of the projections 12', 12" the coil 3 needs to be rotated less far and yet obtains a proper shock resistance, which is advantageous from a viewpoint of production technique.

Figure 7A:
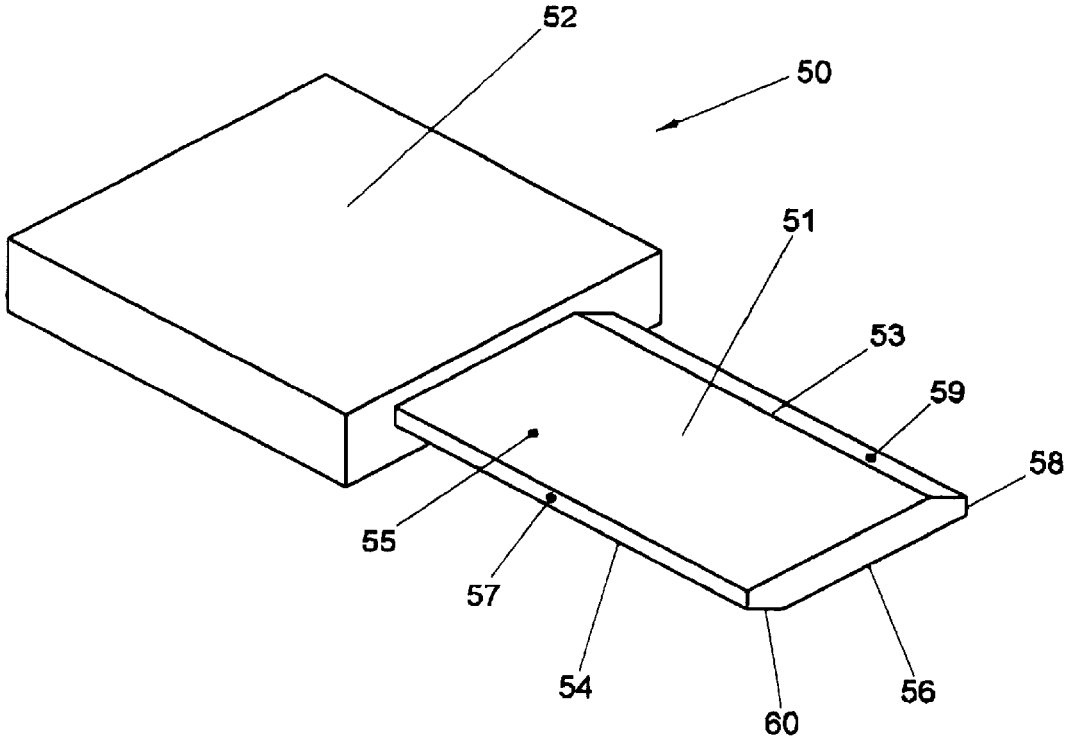
FIG. 7A is a diagrammatic perspective view of an auxiliary, for use in a process for assembling a transducer according to the present invention.

However, as described above, the air gap 4 of the coil 3 has a certain tolerance, which means that for different individual transducers the above angle α must be adjusted to different values to obtain the same value for $F_S$. The invention therefore also relates to a process for fixing the coil 3 of the magnetic member 2, enabling the above angle α to be adjusted for different individual transducers to such a value that the desired freedom of vibration $F_S$ is accurately obtained, independently of uncertainties in the precise dimensions of the air gap 4. By the process proposed according to the present invention an alignment of the coil 3 and the magnetic elements 5, 7 is also obtained in a relatively easy manner. This process will be discussed with reference to FIG. 7A, which diagrammatically shows a preferred embodiment of such a centering auxiliary 50. This centering auxiliary 50 substantially comprises two centering parts 51 and 52 which are aligned with respect to each other. The second centering part 52 may have a contour corresponding to the contour of the second air gap 6. In the illustrated preferred embodiment the second centering part 52 has a substantially rectangular cross section, with an Y-dimension which is slightly smaller than the minimum measure of the second air gap 6, and an X-dimension which is slightly smaller than the inner X-dimension of the magnetic member 2.

Figure 7B:
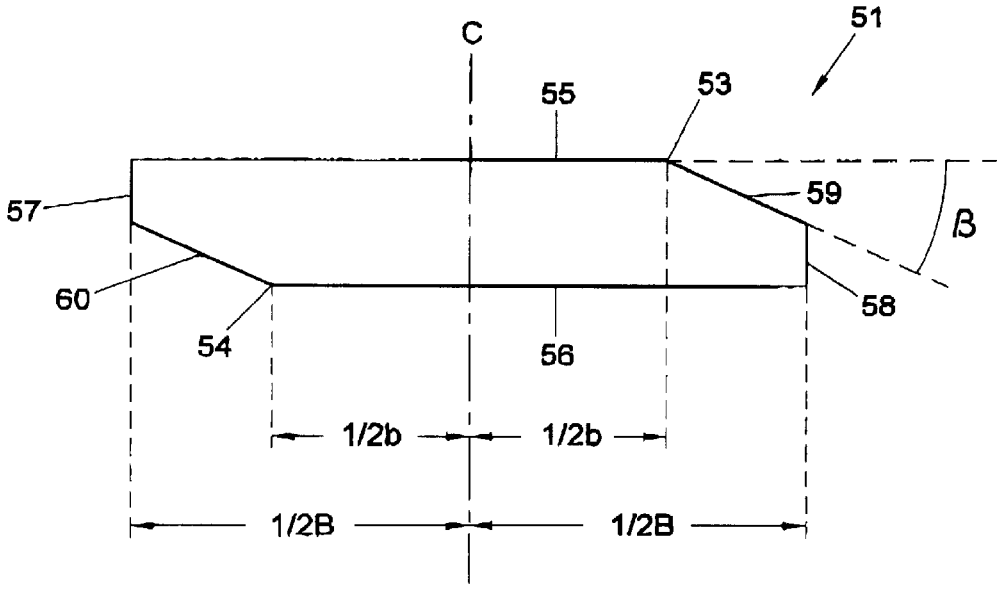
FIG. 7B is a diagrammatic cross-sectional view of the above auxiliary.

The first centering part 51 has an upper face 55 and a lower face 56, which lie parallel with each other but are displaced relative to each other. As compared to the line of symmetry designated by C and directed according to the Y-axis, the upper face 55 has a dimension in the direction of the +X-axis (to the right in FIG. 7B) which is substantially equal to ½b, and a dimension in the direction of the −X-axis (to the left in FIG. 7B) which is slightly smaller than ½B, B being equal to the inner X-dimension of the coil 3. Similarly, the lower face 56, calculated from the above line of symmetry C, has a dimension in the direction of the −X-axis which is substantially equal to ½b, and a dimension in the direction of the +X-axis which is slightly smaller than ½B. The Y-distance between the upper face 55 and the lower face 58 is substantially equal to the thickness d of the middle armature leg 12 plus twice the desired freedom of coil vibration $F_S$.

The first centering part 51 has two side faces 57 and 58, which are substantially at right angles to respectively the upper face 55 and the lower face 58. The X-distance between the two side faces 57 and 58 is therefore slightly less than B.

The first centering part 51 has a first inclined wall portion 59 which connects the upper face 55 to the side face 58. The first inclined wall portion 59 meets the upper face 55 at an edge 53. The first inclined wall portion 59 lies at an angle β to the X-direction, which is larger than α. Similarly, the first centering part 51 has a second inclined wall portion 60 which connects the lower face 58 to the side face 57. The second inclined wall portion 60 meets the lower face 58 at an edge 54. The second inclined wall portion 60 also lies at an angle β to the X-direction, which is larger than α.

When assembling the transducer according to the present invention, first the magnetic member 2 is arranged on the second centering part 52 of the centering auxiliary 50. Then the coil 3 is arranged on the first centering part 51. The coil is then rotated about its longitudinal axis, until the coil 3 touches the first centering part 51 at two points. I.e. the upper coil inner wall 33 touches the side edge 53 of the upper face 55, and the lower coil inner wall 34 touches the side edge 54 of the lower face 56. In a comparable manner the magnetic member 2 is rotated about its longitudinal axis in the opposite direction, until the magnetic member 2 abuts against the second centering part 52.

Because the total X-dimension of the first centering part 51 is slightly smaller than the inner X-dimension of the coil 3, this shape of the first centering part 51 also ensures the centering of the coil 3 in the X-direction. The total X-dimension of the first centering part 51 must be slightly smaller than the inner X-dimension of the coil 3 to allow the rotation of the coil 3. Similarly, the inclined wall portions 59 and 60 allow this rotation, because their angle β is larger than the maximally expected angle α.

It will be clear that thus, irrespective of the precise shape and dimension of the first air gap 4, the upper coil inner wall 33 defines for an armature leg, the width of which is equal to b, a stop having the desired freedom of vibration upwards. The same applies, mutatis mutandis, to the lower coil inner wall 34.

Normally, when mounting a coil and a magnetic member, the facing end walls of this coil and this magnetic member are used as a mutual reference. It is necessary, then, that these end walls be precisely perpendicular to the center lines (Z-axis and Z'-axis) of this coil and this magnetic member, otherwise these parts are not precisely aligned. In the process according to the present invention it is not necessary to use the above end walls as a reference. When according to process according to the present invention the coil 3 and the magnetic member 2 are rotated with respect to each other, until the two of them abut against the centering auxiliary 50, it is also achieved that their center lines are precisely aligned with respect to each other. In this condition the coil 3 is affixed to the magnetic member 2, e.g. with a rapid-hardening adhesive, such as an acrylate adhesive, as known per se.

Finally, the centering auxiliary 50 is removed, and the combination of magnetic member 2 and coil 3 is ready for receiving the armature 10.

It will be clear to a person skilled in the art that the scope of protection of the present invention as defined by the claims is not limited to the embodiments shown in the Figures and discussed, but that it is possible to change or modify the above embodiments of the transducer according to the invention within the scope of the inventive concept. Thus, e.g., it is possible that the armature is a U-shaped armature or has any other suitable form.

It is also possible that the first air gap 4 and/or the second air gap 6 has a non-rectangular cross section. This can be recognized as follows. As regards the second air gap 6, it applies that the freedom of magnet vibration upwards is determined by the lowest point of the upper magnet 7, while the freedom of magnet vibration downwards is determined by the highest point of the lower magnet 5, at the end of the magnetic member 2 facing away from the coil 3, irrespective of the precise shape of the contour of the second air gap 6.

In a comparable manner it always applies as regards the first air gap 4 that the freedom of coil vibration upwards is determined by the distance measured in the Y-direction between the side edge 41 of the middle armature leg 12 directed towards the first armature leg 11 and the upper coil inner wall 33, and that the freedom of coil vibration downwards is determined by the distance measured in the Y-direction between the side edge 43 of the middle armature leg 12 directed towards the third armature leg 13 and the lower coil inner wall 34, irrespective of the precise shape of the contour of the first air gap 4.

It will further be clear to a person skilled in the art that the centering parts 51 and 52 of the centering auxiliary 50 may have other contours. Since of the first centering part 51 only the above edges 53 and 54 and side walls 57 and 58 are involved in the centering function, the middle portion of the first centering part 51 could, e.g., be thinner or even be completely omitted. Also, wall portions and edges may be rounded.

While the present invention has been described with reference to one or more preferred embodiments, those skilled in the art will recognize that many changes may be made thereto without departing from the spirit and scope of the present invention which is set forth in the following claims.

What is claimed is:

1. An electroacoustic transducer, comprising:

a coil having first and second ends and four substantially planar internal walls defining a tunnel, said tunnel having a substantially rectangular cross-section along the entire length of said coil between said first and second ends;

a pair of magnets adjacent to said coil and defining an air gap therebetween, said air gap having a substantially rectangular cross-section, said coil being rotated with respect to said pair of magnets such that said tunnel is at a predetermined angle with respect to said air gap; and an armature extending into said tunnel and said air gap, said armature having an end portion adapted for movement toward and away from each of said pair of magnets.

2. The electroacoustic transducer of claim 1, wherein said predetermined angle is less than 15°.

3. The electroacoustic transducer of claim 2, wherein said predetermined angle is in the range between 7° and 10°.

4. The electroacoustic transducer of claim 1, wherein said cross-section of said tunnel has an area greater than an area defined by said cross-section of said air gap.

5. The electroacoustic transducer of claim 1, wherein said predetermined angle is selected to be a value resulting in said armature engaging said coil and one of said pair of magnets substantially simultaneously when subjected to shock.

6. The electroacoustic transducer of claim 1, wherein said armature is substantially flat within said tunnel and within said air gap, said armature including opposing expanded edge portions extending away from edges of said armature in a direction lateral to a longitudinal axis of said armature, said opposing expanded edge portions being positioned on a region of said armature that is within said tunnel.

7. The electroacoustic transducer of claim 1, wherein said coil includes at least one contact point where said armature engages one of said four internal walls during shock, said contact point being positioned away from said first and second ends.

8. The electroacoustic transducer of claim 1, wherein said armature further includes two outer legs positioned outside of said tunnel and said air gap thereby providing said armature with an E-shape.

9. An electroacoustic transducer, comprising:

a pair of spaced permanent magnets;

a coil having a tunnel with a substantially rectangular cross-section, said coil being rotated to a predetermined angle with respect to said pair of permanent magnets, said predetermined angle being less than 15°; and an armature having a central portion which extends through said coil tunnel and a tip portion which lies at least partially between said pair of magnets, said armature being mounted for deflection towards or away from a respective one of said pair of magnets, said armature being substantially flat and said central portion including opposing expanded edge portions extending laterally away from said central portion, said opposing expanded edge portions being disposed along a segment of the length of said central portion.

10. The electroacoustic transducer of claim 9, wherein said predetermined angle is in the range between 7° and 10°.

11. The electroacoustic transducer of claim 9, wherein said pair of spaced permanent magnets define a substantially rectangular cross-section.

12. The electroacoustic transducer of claim 9, wherein each of said opposing expanded edge portions of said armature has a generally rectangular periphery when viewed in a direction perpendicular to a longitudinal axis of said armature.

13. The electroacoustic transducer of claim 9, wherein said predetermined angle is selected to be a value resulting in said armature engaging said coil and one of said pair of magnets substantially simultaneously when subjected to shock.

14. The electroacoustic transducer of claim 9, wherein said segment of said central portion at which said opposing expanded edge portions are disposed is located between the ends of said tunnel.

15. An electroacoustic transducer comprising:

first and second magnets having, respectively, a first surface and a second surface, said first surface being spaced away from and generally parallel to said second surface;

a coil having a substantially rectangular tunnel partially defined by an upper surface and a lower surface, said upper surface and said lower surface being generally parallel, said coil being adjacent to said first and second magnets, said coil being rotated with respect to said pair of magnets such that said upper surface is at a predetermined angle with respect to said first surface of said first magnet and said lower surface is substantially at said predetermined angle with respect to said second surface of said second magnet; and an armature extending through said tunnel and between said magnets.

16. The electroacoustic transducer of claim 15, wherein said armature is substantially flat within said tunnel, said armature further including opposing expanded edge portions extending laterally away from a longitudinal axis of said armature, said opposing expanded edge portions being located on a region of said armature between the ends of said tunnel.

17. The electroacoustic transducer of claim 15, wherein each of said upper and lower surfaces of coil includes a contact point where said armature engages during shock, said contact points being located between the ends of said tunnel.

18. The electroacoustic transducer of claim 15, wherein said predetermined angle is in the range between 7° and 10°.

19. The electroacoustic transducer of claim 15, wherein said armature further includes two outer legs positioned outside of said tunnel and a gap between said first and second magnets thereby providing said armature with an E-shape.

20. The electroacoustic transducer of claim 15, wherein said predetermined angle is selected to be a value resulting in said armature engaging said coil and one of said magnets substantially simultaneously when subjected to shock.

* * * * *